US006443400B2

(12) United States Patent
Murata et al.

(10) Patent No.: US 6,443,400 B2
(45) Date of Patent: Sep. 3, 2002

(54) AUTOMATIC TRANSPORT SYSTEM

(75) Inventors: Masanao Murata; Senzo Kyutoku; Hisashi Onishi, all of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/741,398

(22) Filed: Dec. 20, 2000

(30) Foreign Application Priority Data

Dec. 20, 1999 (JP) ..... 11-361962
Oct. 23, 2000 (JP) ..... 2000-323369

(51) Int. Cl.[7] ..... B60Q 1/00
(52) U.S. Cl. ..... 246/1 R; 246/1 C; 340/435
(58) Field of Search ..... 180/167, 168, 180/169; 340/901, 425.5, 435, 436; 356/141.1, 141.4, 141.5; 246/1 R, 1 C, 167 R, 122 R

(56) References Cited

U.S. PATENT DOCUMENTS 3,011,580 A * 12/1961 Reid ..... 180/169
3,448,822 A * 6/1969 Lone et al. ..... 180/169
4,039,782 A * 8/1977 Burckhardt et al. ..... 180/169
4,049,961 A * 9/1977 Marcy ..... 180/169
4,632,543 A * 12/1986 Endo ..... 180/167
5,831,717 A * 11/1998 Ikebuchi ..... 180/169
6,204,755 B1 * 3/2001 Kikuchi ..... 180/169
6,307,622 B1 * 10/2001 Lewis ..... 180/169
6,311,123 B1 * 10/2001 Nakamura et al. ..... 123/352

* cited by examiner

*Primary Examiner*—Mark T. Le
(74) *Attorney, Agent, or Firm*—Scully, Scott, Murphy & Presser

(57) ABSTRACT

The present invention improves the transportation efficiency of an automatic transport system for transporting and article to attain the above object, the automatic transport system includes a front detecting device which detects an obstruction in a non-contact state in an area through which an automatic transport vehicle passes and a projection surface of the automatic transport vehicle. When the front detecting device detects the obstruction in the area, the running speed of the automatic transport vehicle is reduced or the automatic transport vehicle is stopped.

5 Claims, 9 Drawing Sheets

AUTOMATIC TRANSPORT SYSTEM

BACKGROUND OF THE INVENTION

1. Field of the Invention

The present invention relates to an automatic transport system for transporting articles by an automatic transport vehicle at an assembly location in a plant and the like without human attendance, and particularly to an automatic transport system which detects by a sensor an obstruction located ahead of the automatic transport vehicle in its moving direction to control the operation of the automatic transport vehicle.

2. Description of Related Art

Automatic transport vehicles (hereinafter referred to as vehicles) are advantageously used in transporting parts in an assembly process in a plant and the like. Particularly, in a manufacturing semiconductor process, vehicles are used in transferring and assembling semiconductor wafers in the clean room without human intervention for preventing the contamination-with dust and the like. For example, an Overhead Hoist Transport vehicle (hereinafter referred-to as "OHT vehicle"), which travels along a ceiling rail in the clean room is used in the assembly process of semiconductor wafers and the liquid crystal devices.

Moreover, an optical beam reflection sensor. (hereinafter referred to as "optical sensor") such as an infrared type sensor, serving as a non-contact obstruction detecting apparatus of vehicles. The optical sensor detects an obstruction ahead in the moving direction by emitting an optical beam which is conical-shaped. If a long range detection sensor is provided at the front of the vehicle as a front detection sensor, the vehicle is stopped when the long range detection sensor is triggered while it is traveling. If a vehicle has two front detection sensor as a front detection sensor, detection may be carried out in two steps by two front detection sensors.

FIG. 9 is an operation conceptual view of an OHT system used in the semiconductor wafer manufacturing process or the like. The right portion of FIG. 9 is a side view of an OHT vehicle and the left portion of FIG. 9 is a view showing a projection of the OHT vehicle ahead in the moving direction at a predetermined position in the. moving direction.

In FIG. 9, a rail 21 is laid down on a ceiling of a clean room (not shown) along the process line, and a part of the rail 21 is shown therein. An OHT vehicle 22 movably hangs on a lower portion of the rail 21. For example, the OHT vehicle 22 is constituted such that it has a box-like frame and can hold a wafer cassette 23 in this frame and runs along the rail 21.

Moreover, a front detection sensor 24 is attached to the front portion of the OHP vehicle 22 in the moving direction. As the front detection sensor 24, an optical sensor of such as an infrared sensor is generally used such that an obstruction in the moving direction of the OHT vehicle 22 can be detected in a non-contact state. In other words, an obstruction ahead is detected by optical beams emitted in a conical shape from the front detection sensor 24. Then, when the front detection sensor 24 detects the obstruction ahead, the OHT vehicle 22 is designed to automatically stop.

Additionally, in FIG. 9, although the front detection sensor 24 at the left side surface of the OHT vehicle 22 is provided for movement to the left side of the figure, the OHT vehicle 22 normally moves in two directions. In such a case, the front detection sensor 24 is also provided at the right side surface of the OHT vehicle 22.

However, in some cases, an associated manufacturing apparatus may be present very close to the periphery of the rail 21, the door of the manufacturing apparatus may be opened, or parts being processed are located close to the periphery of the rail 21. Further, in other cases, in locations outside of the passage of the OHT vehicle 22, there may be a stepladder, a workbench or the like for maintenance, or a person. For this reason, in order to prevent the OHT vehicle 22 from colliding with them, the front detection sensor 24 on the OHT vehicle 22 detect obstructions ahead. However, as shown in FIG. 9, if the detection area of light emitted from the front detection sensor 24 is widened as shown in a detection area A in order to detect obstructions located in the passage area of the OHT vehicle 22, there is a possibility that objects which are at the periphery of the running path will unnecessarily be detected and that the OHT vehicle 22 will not run.

In other words, the left side of the drawing indicates the passage area C of the OHT vehicle 22, as seen from the front of the OHT vehicle 22 in the moving direction, by a solid line. Also, a wide detection area A where the entire passage area C of the OHT vehicle 22 can be detected is indicated by a broken line. This large detection area A is the bottom surface of the cone of the-light beam emitted by the front detection sensor 24 at a predetermined position.

Unlike the wide circular detection area A that is the bottom of a conical surface, if the front shape of the OHT vehicle 22 that is the passage area C of the OHT vehicle 22 is rectangular, for example, as illustrated in the figure, excess detection area D, in which the wide detection area A lies outside of the passage area C to be detected will occur. If an object is located in this excess detection area D, the OHT vehicle 22 will stopped even though the object is not actually obstructing the passage of the OHT vehicle 22.

On the other hand, if the detection area is narrowed as in the narrow detection area B indicated by a broken line, the corner portions of the passage area C of the OHT vehicle 22 cannot be detected, and form a non-detection area E. In such a case, there is the concern that the OHT vehicle 22 will collide with an object in the non-detection area E which is in the corner portion of the vehicle, when the vehicle passes the object.

FIG. 10 is an explanatory view showing the front detection sensor of the OHT vehicle 22 and an example of an obstruction. As illustrated in this figure, a stepladder 25 is placed in front, in the moving direction, of the OHT vehicle 22. In this case, if the detection area at the front detection sensor 24 is wide, as in the wide detection area A, the stepladder 25 is detected as an obstruction and the OHT vehicle 22 is stopped even though the OHT vehicle 22 will not collide with the stepladder 25. Furthermore, if the detection area is narrowed as in the narrow detection area B, the stepladder 25 is not detected. However, if workpieses or the like are placed at a location very close to the OHT vehicle 22, there is the concern that the OHT vehicle 22 will collide with them and break them since they cannot be detected.

FIG. 11 is a conceptual view showing an OHT vehicle used in a semiconductor manufacturing apparatus. As illustrated in this figure, for example, in the apparatus for manufacturing a 300 mm wafer, a distance P between the end surface of the OHT vehicle 22 that transports the wafer and the front surface of the semiconductor manufacturing apparatus 26 is set to about 30 mm on the basis of a standard distance. It is assumed that working is carried out in such small distances. If the detection area is too wide, the front detection sensor 24 will detect the door of the semiconductor manufacturing apparatus 26, so that the OHT vehicle 22 will not operates well and workcannot be carried out. Moreover, if the detection area is narrowed, there is the concern that the corner of the OHT vehicle 22 will contact semiconductor wafers (not shown) mounted on the semiconductor manufacturing apparatus 26 and these semiconductor wafers will be broken.

FIG. 12 is a conceptual view showing a vehicle using two front detection sensors for long range and medium range detection. The vehicle 111 is provided with a medium range detection sensor (not shown) which can detect over a medium detection range 113 and a long range detection sensor (not shown) which can detect over a long detection range 112. The vehicle 111 detect an obstruction which is loaded ahead in moving direction by switching the respective sensors. Then, control is performed so that the speed of the vehicle 111 is reduced when the long range detection sensor works and makes a detection within the long detection range 112 and the vehicle 111 is stopped when the medium range detection sensor makes a detection in the medium detection range 113.

FIG. 13 is a conceptual view showing an example of the operation state of a plurality of vehicles in a general OHT system. This figure is a conceptual view to explain a system in which a transport apparatus comprising a plurality of vehicles operating between the assembly apparatuses such as a plurality of semiconductor manufacturing apparatuses. In this figure, a rail 124 is provided along a plurality of assembly apparatuses 121, 122, 123, and a plurality of vehicles 125 and 126 travel on the rail 124. Then, in the case of operating the transport apparatus comprising a plurality of vehicles 125 and 126 which detect an obstruction which is located ahead by the front detection sensor as shown in FIG. 12, described above, it is effective for the respective vehicles 125 and 126 to made to be as close as possible to the vehicle in front when stopping in order to increase the transport efficiency of the system.

The transport efficiency of the transport system largely differs depending on whether the trailing vehicle 126 can move to a position G or only to a position H when the front vehicle 125 is placed at a position F as shown in FIG. 13. For example, it is assumed that there are requests for transfer from transfer ports 127 at positions F and G simultaneously in the assembly apparatus 121. If the trailing vehicle 126 can move to the position G when the front vehicle 125 is stopped at the position F, the simultaneous transfer can be carried out at the positions F and G. However, if the trailing vehicle 126 can move to only the position H, the trailing vehicle 126 cannot move to the position G until the front vehicle 125 finishes transferring at the position F and leaves the position F. Therefore, the transfer efficiency of the trailing vehicle 126 at the position G is decreased.

On the other hand, the conventional use of the general front detection sensors is described below. Specifically, as explained in the FIG. 12, when the vehicle moves close to the obstruction, the long range detection sensor detects the obstruction located the long detection range 112, firstly. Next, the sensor is changed to the medium range detection sensor or the detection range of the long range detection sensor is shortened to carry out the detection of the obstruction in the medium detection range 113. In this way, the detection range of sensor is shortened in two steps, the speed of the vehicle 111 is reduced, and then the vehicle stops at a predetermined position. In order to stop a vehicle 111 moving at a high speed before colliding with an obstruction, it is necessary to allow for a braking distance to start braking. For this reason, the detection occur in two steps for the long detection range 112 and the medium detection range 113 in the operation control of the vehicle 111.

However, in this case as described above, the front vehicle, which is regarded as an obstruction, may move forwards and is no longer regarded as an obstruction in some cases. This results in unnecessary braking, which reduces. the operation efficiency of the entire OHT system. There is a method of preventing the unnecessary braking, that is to reduce the moving speed of the vehicle and to shorten the braking distance. However, this results in a reduction in the operating speed, so that the operation efficiency of the entirety of the OHT system is reduced after all.

For this reason, in the general OHT system, the speed of the vehicle is reduced in the long detection range or the medium detection range based on the detection result of the long range detection sensor, and the vehicle is stopped in the short detection range, which is very close to the front vehicle. The switching between the long detection range and the medium detection range using the long range detection sensor is generally decided based on the size of the vehicle and the speed, or the degree of the speed reduction or the like and the switching is decided such that after the operation of the long range detection sensor, the speed reduction of the vehicle and the stopping thereof are completed before the trailing vehicle contacts the obstruction. For example when executing long range detection, the vehicle is operated if the distance between the obstruction ahead and the vehicle is 2 to 3 m. When executing medium range detection, the vehicle continues to operate when the distance between the obstruction ahead and the vehicle is 0.5 to 1.5 m. When executing short range detection, which covers shorter distances than the above, the vehicle is stopped. In this way, the distance between the obstruction ahead and the vehicle is predetermined in each detective range.

If the vehicle is moving at high speed, it is necessary to reduce the detection range as little as possible after switching the detection range to the medium detection range from the long distance detection in order to stop the vehicle safely by the short range detection sensor after the operation of the long range detection sensor. However, the reduction of the detection range is limited to the braking distance of the vehicle, so that the medium detection range cannot be shortened much.

SUMMARY OF THE INVENTION

In view of the foregoing, an objective of the present invention is to provide an automatic transport vehicle providing sensors that can detect an obstruction present an area through which the automatic transport vehicle passes without losing the operation efficiency of the transport system.

Moreover, in an automatic transport vehicle comprising a plurality of vehicles, it is determined whether or not an obstacle ahead is a vehicle, and when the obstruction ahead is a vehicle, the distance up to the vehicle is shortened and the trailing vehicle is stopped, which makes it possible to improve the operation efficiency of an OHT system.

In order to solve the above-described problems and attain the above described objectives, the present invention provides an automatic transport system for transporting articles, comprising a front detecting device which detects an obstruction in a non-contact state in an area through which an automatic transport vehicle passes, and a projection surface of said automatic transport vehicle, and when said front detecting device detects the obstruction in said area, the running speed of said automatic transport vehicle is reduced or said automatic-transport vehicle is stopped.

Since the front detecting device of the present invention detects an obstruction which is located only the vehicle pass area of the actual passage region of the automatic transport vehicle. Therefore, in this transport system, only an object which located in the vehicle pass area is detected, and parts or the like in a position very close to a vehicle, but which does not impede the running of the vehicle, are not detected. In an automatic transport system, which is used in the assembly process of a semiconductor manufacturing apparatus, it is necessary to transport the workpieses or the like in the extremely narrow range to run the automatic transport vehicle. For this reason, the use of the automatic transport system of the present invention further improves the work efficiency.

Moreover, according to the automatic transport system, in the above-described invention, said front detecting device is an optical sensor, which emits an optical beam so as to irradiate an entire outer periphery of a projection surface of said automatic transport vehicle, and said optical sensor detects an obstruction in said area. Then, only the outer periphery of the area where the automatic transport vehicle passes is irradiated with the optical beam to detect the reflected light of this optical beam, making it possible to easily carry out detection in only the passage area of the automatic transport vehicle.

Furthermore, according to the automatic transport system of the above-described invention, a plurality of said optical sensors are provided near the outer periphery of a front surface of said automatic transport vehicle, said optical sensors respectively emit the optical beams that irradiate a area throughout an entire outer periphery of the projection surface of said automatic transport vehicle, and said optical beams are fan-shaped.

The plurality of optical sensors are provided near the outer periphery of a front surface of the automatic transport vehicle in the moving direction. Then, the entire outer periphery of the running area is irradiated in the shape of a strip with the optical beams emitted from the respective optical sensors. As a specific method, for example, in the case of the automatic transport vehicle whose front surface in the moving direction is rectangular, if the strip slits are provided along the respective sides of the rectangle and the optical beams are emitted from the interior of these slits in the shape of a fan, the entire corresponding side of the rectangle, which is equivalent to a passage area, is irradiated with the optical beams. Therefore, the strip irradiation areas of the respective sides are combined with one another, making it possible to irradiate the outer periphery of the entire vehicle moving area the shape of a strip with the optical beams.

Moreover, according to the automatic transport system in the above-described invention, wherein the area irradiated by said optical beams lies partially outside of the outer area of said projection surface. Then, it is desirable that a slight allowance be provided in the width of the detection area such that erroneous detection of obstacles and a miss of detection can be prevented by mechanical shifts occurring when the automatic transport vehicle moves.

Still further, according to the automatic transport system of the present invention, the automatic transport vehicles constituting the automatic transport system of each invention as described above can be used in precision work, such as in a semiconductor manufacturing apparatus, and it can be employed in an Automatic Guided Vehicle (hereinafter referred to as "AGV")running-on the floor, a Rail Guided Vehicle (hereinafter referred to as "RGV") running on a rail on the floor, which transport materials, parts, products or the like in automated plants or the like, other than an OHT, which runs on a ceiling rail.

The automatic transport system of the present invention is an automatic transport system, which comprises a plurality of vehicles running on a rail. The vehicles detect obstructions ahead in the moving direction and whether or not the obstruction is an automatic transport vehicle that runs in the front, so as to perform running control. According to the automatic transport system of the present invention, the running control differs depending on whether the obstruction ahead is a vehicle, and if the obstruction ahead is the vehicle, the vehicle is moved forward as much as possible to improve the entire transportation efficiency. In addition, the rail to which the present invention refers is not limited to a rail whose running route is physically constrained and the like. For example, a running route that runs on the floor and the like are also included therein.

Furthermore, according to the automatic transport system of the present invention, in the above invention, each of said plurality of vehicles comprises front detecting device for detecting whether at least two kinds of obstructions are present ahead and obstruction determining device which determine whether the obstructions detected by the detecting of the front detecting device are vehicles running ahead, and running control of the vehicles is performed based on the detection result of the front detecting device and the identification result of the obstruction determining device.

According to the automatic transport system of the present invention, identification of whether an obstruction ahead is not a vehicle or is a vehicle running ahead is correctly performed. Then, the stopping of the trailing vehicle or the effective forward movement are carried out based on the identification result. This makes it possible to further improve the productivity of the entire system as compared with the conventional OHT transport system. Thus, running control can be carried out so that obstacles located in an area through which the vehicle passes can be detected with more reliability without losing the transportation efficiency of the system.

Still further, according to the automatic transport system of the present invention, in the above-described invention, said front detecting device comprises a long range detection sensor which detects an obstruction. located in a long range, and a short range detection sensor which detects an obstruction located in a short range, said obstruction determining device determines whether or not an obstruction ahead detected by said long range detection sensor is an automatic transport vehicle running ahead, and running control of said automatic transport vehicle is performed based on a detection result of said long range detection sensor, an determining result of said obstruction determining device, and detection result of said short range detection sensor.

According to the automatic transport system of the present invention, the long range detection sensor, which has a relatively long detection range, detects obstructions, and the obstruction determining device identifies whether the detected obstruction is a vehicle. Then, the short range detection sensor, which has a short detection range, performs the stopping of the vehicle and control of the speed reduction based on the identification result of whether or not the detected obstruction is a vehicle, and on the distance to the obstruction.

In addition, according to the automatic transport system of-the present invention, in the above-described invention, when the long range detection sensor detects an obstruction and the obstruction determining device identifies that the obstruction detected by the long range detection sensor is a vehicle running ahead, the vehicle moves ahead until the short range detection sensor detects the vehicle, and when the short range detection sensor detects the vehicle, the vehicle is stopped.

Still further, when the long range detection sensor detects an obstruction and the obstruction determining device identifies that the obstruction detected by the long range detection sensor is not a vehicle running ahead, the vehicle is immediately stopped, or when the short range detection sensor detects the vehicle, the vehicle is stopped.

According to the automatic transport system of the present invention, different and detailed operation control is performed depending on whether the obstruction ahead is a vehicle. If the obstruction ahead is a vehicle, the forward movement is effectively performed to improve the operation efficiency. Moreover, if the obstruction ahead is not a vehicle, the trailing vehicle is stopped at a safe distance and can be set to a standby state. For example, when a worker is working on the transportation rail, the worker is not erroneously recognized as a vehicle even if the worker is detected as an obstruction. For this reason, the trailing vehicle can be promptly stopped as required by the operation, which is different from the forward movement of the vehicle. As a result, the vehicle waits at a distance without approaching the worker, and this makes it possible to ease any concern that the worker may feel if the vehicle approaches the worker.

Furthermore, according to the automatic transport system of the present invention, in the above-described invention, the obstruction determining device. comprises a light emitting device, which is provided at a rear portion of a vehicle running ahead, and a light receiving device, which is provided at a front portion of a trailing vehicle. Alternatively, the obstruction determining device may comprise a reflector, which is provided at a rear portion of the vehicle running ahead, and a reflection sensor for receiving a reflected light, which is provided at a front portion of a trailing vehicle.

Still further, according to the automatic transport system of the present invention, in the above-described invention, the front detecting device is a plurality of optical sensors, which are provided over a predetermined periphery at a front portion of the vehicle, and the obstruction determining device comprises a logic circuit for signals from the plurality of optical sensors.

According to the automatic transport system of the present invention, the plurality of optical sensors are arranged around a predetermined periphery near an outer peripheral of the front surface of the vehicle in the moving direction, that is the entire periphery. Then, the entire outer periphery of the vehicle moving area is irradiated in the shape of a strip with the optical beams emitted from the respective optical sensors. As a specific method, for example, in the case of a vehicle whose front surface in the moving direction is rectangular, if the strip slits are provided along the respective sides of the rectangle and fan-shaped optical beams are emitted from these slits, the entire corresponding side of the rectangle, serving as a passage area, is irradiated with the optical beams. Therefore, the strip irradiation areas of the respective sides are combined with one another, making it possible to irradiate the outer periphery of the entire vehicle moving area in the shape of a strip with the optical beams. Additionally, if a logical calculation based on the signals from the plurality of optical sensors, for example, a logical sum, is performed, it is possible to detect that the obstruction is the vehicle only when the obstruction ahead is the vehicle.

Still further, in an automatic transport system that comprises a plurality of vehicles according to the present invention, the vehicles can be used in an AGV, RGV, or the like other than an OHT, which runs on ceiling rails.

As explained above, according to the automatic transport system of the present invention, since the automatic transport vehicle detects only substantially the area though which the automatic transport vehicle moved, only actual obstructions will be detected, without fail. There is no concern that an object or a person, which do not actually impede the running of the apparatus, will be detected, or that ark obstruction will not be detected, causing unnecessary stopping and damage of objects. Therefore, the automatic transport vehicle can be run safely and efficiently, so that a safe and efficient automatic production system can be constructed.

According to the automatic transport system of the present invention, an obstruction present at in the area though which the vehicle of the moving direction will pass can be detected with more reliability without losing the transportation efficiency of the system. Also, identification of whether a obstruction ahead is a vehicle running ahead or not is correctly performed. Then, stopping of the trailing vehicle and the effective forward movement are carried out based on the identification result. This makes it possible to further improve the productivity of the entire system as compared with a conventional OHT transport system. Moreover, when a worker is working on the transportation rail, the worker is not erroneously recognized as a vehicle even if the worker is detected as an obstruction. For this reason, the trailing vehicle can be promptly stopped as required by the operation, which is different from the forward movement of the vehicle. As a result, the vehicle waits at a distance without. approaching the worker, and this makes it possible to ease any concern that the worker may feel if the vehicle approaches the worker.

BRIEF DESCRIPTION OF THE DRAWINGS

For more complete understanding of the present invention and the advantages thereof, reference is now made to the following description taken in conjunction with the accompanying drawings, in which;

FIG. 9 is an operation conceptual view of the OHT system used in the semiconductor wafer manufacturing process or the like;

DETAILED DESCRIPTION OF THE INVENTION

The following will specifically describe the preferred embodiment of the automatic transport system. according to the present invention with reference to the drawings. Additionally, in the following description, the rail for running is omitted, and an OHT vehicle with a rectangular cross-sectional shape of its front surface, which is considered to be the passage area, is explained as an example.

Figure 1:
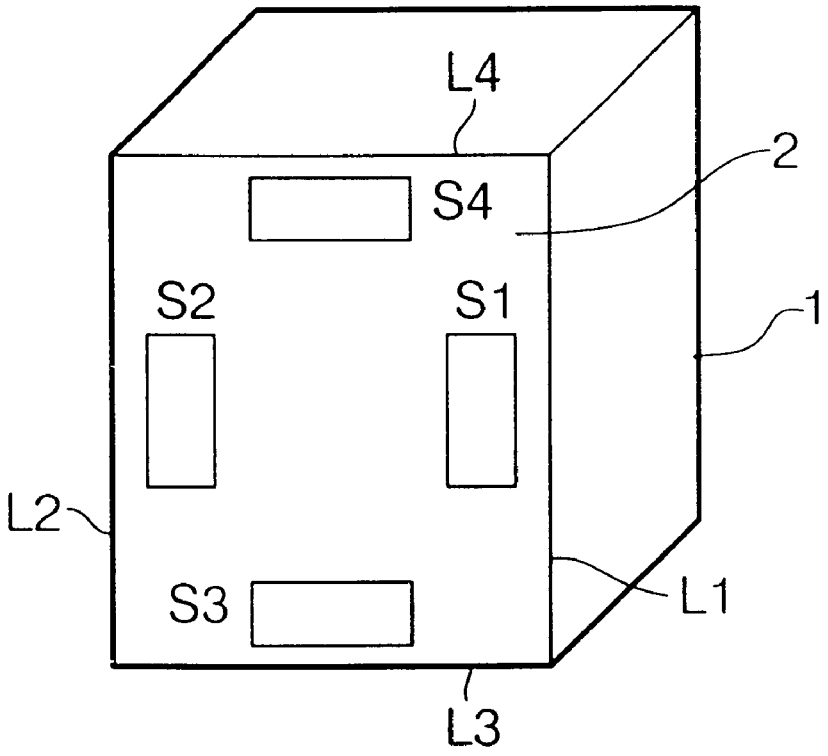
FIG. 1 is an outline perspective view of an OHT vehicle according to the embodiment of the present invention.

FIG. 1 is an outline perspective view of an OHT vehicle according to an embodiment of the present invention. In the FIG. 1, at the front surface portion 2 of an OHT vehicle 1 in the moving direction, four optical sensors S1, S2, S3, and S4 are arranged along the respective sides of the front surface portion 2 in the moving direction as front detection sensors.

In order to reserve a minimum area through which the OHT vehicle 1 passes, the optical sensor S1, which emits a fan-shaped beam of light, is placed along the side L1. Similarly, the optical sensors S2, S3, and S4 are arranged along the sides L2, L3, and L4, respectively.

Each of the optical sensors S1, S2, S3, and S4 is constituted to have a thin and rectangular slit, for example, along the portion close to each of the sides L1, L2, L3, and L4, and an infrared light source is provided in each slit, a light beam from the infrared light source (not shown) is emitted from each slit. Therefore, the respective optical beams are emitted from the respective optical sensors S1, S2, S3, and S4 in the shapes of fans, and the irradiated light has a cross-sectional shape that is similar to the shape of each slit on a projection surface at a predetermined position.

Figure 2:
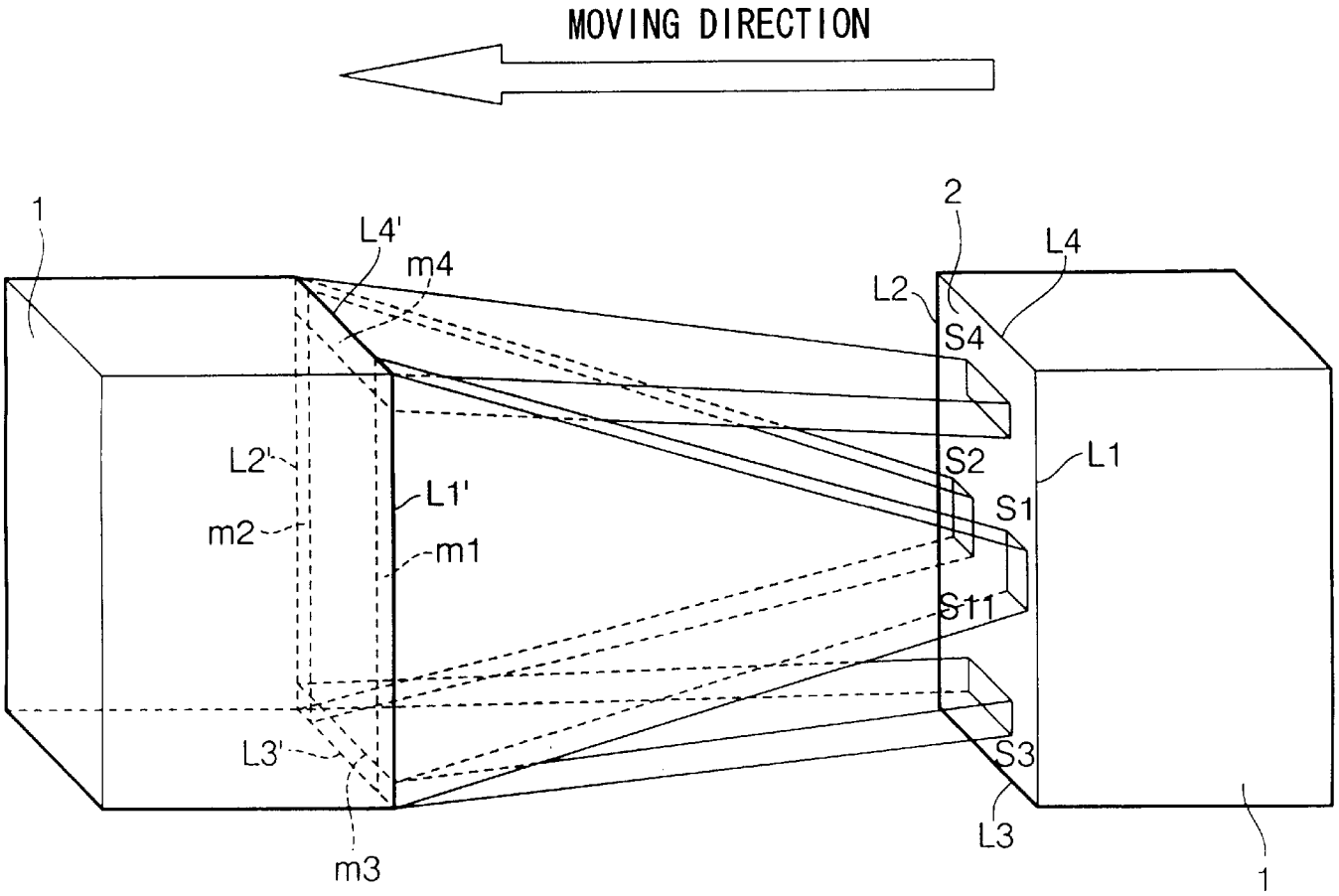
FIG. 2 is a conceptual view showing a state in which the front in the moving direction is detected using the OHT vehicle of FIG. 1.

FIG. 2 is a conceptual view showing a state in which the front in the moving direction is detected using the OHT vehicle of FIG. 1. The same figure shows a state in which an imaginary OHT vehicle 1' having the same shape as the OHT vehicle 1 is located ahead in the moving direction of the OHT vehicle 1.

On the front surface portion 2 of the OHT vehicle 1 in the moving direction, the optical sensors S1, S2, S3, and S4 are arranged along the sides L1, L2, L3, and L4. Then, an irradiation area m1 is irradiated with the light beam emitted from the optical sensor S1 along a side L1' of the imaginary OHT vehicle 1'. Also, an irradiation area m2 is irradiated with the light beam emitted from the optical sensor S2 along a side L2' of the imaginary OHT vehicle 1'. Moreover, ad irradiation area m3 is irradiated with the light beam emitted from the optical sensor S3 along a side L3' of the imaginary OHT vehicle 1'. Then, an irradiation area m4 is irradiated with the light beam emitted from the optical sensor S4 along a side L4' of the imaginary OHT vehicle 1'.

Moreover, lights from the optical beams reflected by these irradiation areas m1, m2, m3 and m4 are detected by the optical sensors S1, S2, S3, and S4, respectively. A detection area which an. obstruction is detected is the strip irradiation areas m1, m2, m3 and m4 of the beam light expanded in the shape of fan from the respective optical sensors S1, S2, S3, and S4.

This makes it possible to detect obstructions in the area which is surrounded by the sides L1', L2', L3' and L4' of the imaginary OHT vehicle 1' and in the passage area which is surrounded with the sides L1, L2, L3, and L4 of the front surface portion 2 of the OHT vehicle 1 in the moving direction. Therefore detection can be carried out without failures. In addition, the detection area is the area of the front surface portion 2 of the OHT vehicle 1 in the moving direction and the detection of obstructions in the OHT system can be carried out extremely efficiently without the occurrence of a detection leakage or an excessive detection.

Additionally, in performing the actual detection of obstructions, the setting of the direction of irradiation of the optical beams emitted by the respective optical sensors S1, S2, S3 and S4 is contrived to as to irradiate areas which are a little wider than that passage area of the OHT vehicle 1. However, it is desirable to avoid detection of the peripheral manufacturing apparatuses. Also, it is desirable to prevent unnecessary detections and due to mechanical shift caused by vibration when the OHT vehicle 1 moves.

Regarding the specific method for setting the optical beams, for example, the respective optical sensors S1, S2, S3, and S4 can be provided with an optical guide cylinder for restricting the direction in which light is emitted. Then, the directions of the optical beams emitted from the respective optical guide cylinder are controlled to be directed slightly to the outside of the outer periphery of the imaginary OHT vehicle 1'. If the irradiation areas m1, m2, m3, and m4 of FIG. 2 are extended to slightly outside of the sides L1', L2', L3' and L4' of the imaginary OHT vehicle 1', an areas which is a little wider than the passage area of the OHT vehicle 1 can be detected.

In this way, if the optical sensors for emitting the fan-shaped optical beams are arranged around the front surface of the OHT vehicle 1 in the moving direction and detect only the passage area of the OHT vehicle 1 efficiently, unnecessary stops of the OHT vehicle 1 and unexpected collisions with parts or the like can be prevented, and the OHT vehicle 1 can be efficiently operated.

The above embodiment describes an OHT vehicle 1 whose cross-section in the moving direction is rectangular. However, the cross-sectional shape in the moving direction is not limited to a rectangle, and the present invention can be applied to any cross-sectional shape. For example, if the cross-section of the OHT vehicle in the moving direction is polygonal, the irradiation of strips of light may be provided such that the respective sides are connected to one another to made a polygonal shape. Moreover, if the cross-section of the OUT vehicle in the moving direction is an elliptical shape, irradiation of the strips of light may be provided at the entire the outer periphery of the elliptical shape.

Figure 3:
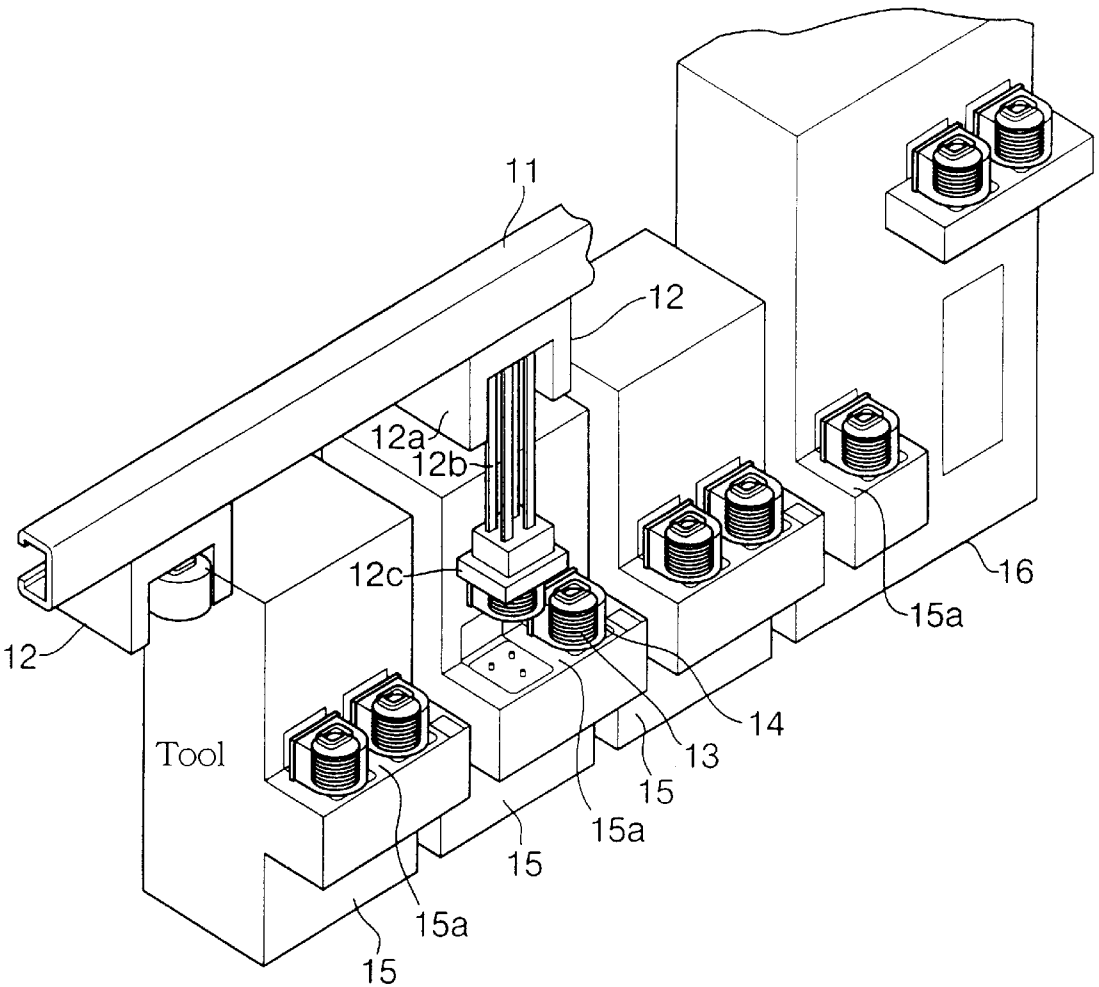
FIG. 3 is a perspective view showing one example of a semiconductor manufacturing apparatus using an OHT vehicle of the present invention.

Next, a description is given of the actual use of an OHT vehicle having the aforementioned front detection sensor. FIG. 3 is a perspective view showing one example of a semiconductor manufacturing apparatus using the OHT vehicle of the present invention.

In the case of manufacturing a semiconductor device by the semiconductor manufacturing device illustrated in FIG. 3, the aforementioned OHT vehicle is used to automatically transport semiconductor wafers among various kinds of apparatuses. Generally, semiconductor wafers such as silicon wafers are transported by moving the OHT vehicle back and forth among various kinds of semiconductor manufacturing apparatuses (for example, a wafer processing apparatus, a storage apparatus, a workbench, a buffer apparatus, and so on), whereby the semiconductor devices are manufactured via numerous processes.

The process in which the OHT vehicle transports the semiconductor wafers is explained with reference to FIG. 3. An OHT vehicle 12, which hangs on a rail 11 mounted on a ceiling of a clean room (not shown), runs freely, and a wafer carrier 14 on which semiconductor wafers 13 are leaded is transferred between the respective semiconductor manufacturing apparatuses 15 or between a semiconductor manufacturing apparatus 15 and a stocker 16, and various kinds of processes are carried out on the wafers.

The OHT vehicle 12 shown in this figure comprises a running section 12*a* that runs along the rail 11, a hanging section 12*b* that is provided at a lower portion of the running section 12*a*, and a hand 12*c* that hangs from the hanging section 12*b* to be movable up and down. Specifically, the wafer carrier 14 that is placed on a load port 15*a* of the semiconductor manufacturing apparatus 15 is held by the hand 12*c*. Then, the hanging section 12*b* moves up the hand 12*c*, thereafter the OHT vehicle 12 runs along the rail 11 by the running section 12*a*.

In manufacturing the semiconductor device, a plurality of OHT vehicles 12 move back and forth between the plurality of semiconductor manufacturing apparatuses 15 arranged in parallel along the rail 11, and hold the wafer carrier 14 from the load port 15*a* of each semiconductor manufacturing apparatus 15 to be transferred to the load port 15*a* of another semiconductor manufacturing apparatus 15.

In transporting the wafer carrier 14, the OHT vehicle 12 first runs along the rail 11 and is stopped at the portion above the load port 15*a* having the wafer carrier 14 to be transported thereon. Then, the hand hanging section 12*b* is lowered to move the hand 12*c* down, and this hand 12*c* holds the wafer carrier 14. Then, the hand hanging section 12*b* is hoisted up to remove the wafer carrier 14 from the load port 15*a* and to be the highest position. Thereafter, the OHT vehicle 12 is run again.

Then, the OHT vehicle 12 is stopped at another semiconductor manufacturing apparatus 15, which performs the next process, or the load port 15*a* of the stocker 16. Then, the hand hanging section 12*b* is lowered to lower the hand 12*c* so that the wafer carrier 14 is mounted on the load port 15*a*. Thereafter, the hand 12*c* releases the wafer carrier 14. Then, the hand hanging section 12*b* is hoisted up to raise the hand 12*c*, and the operation proceeds to the a next transporting operation.

Incidentally, the aforementioned transport system has a vehicle providing the front detection sensor (not shown) which detects an obstruction in the minimum range with no obstruction to movement of the OHT vehicle 12. Therefore in the transport system can prevent the OHT vehicle 12 from contacting the doors of various kinds of apparatuses placed in the moving direction of the OHT vehicle 12, adjacent parts or the like, and from being stopped after detecting doors and parts even though they are not obstructing the movement of the OHT vehicle 12, since the transport work carry out in a small area. The detecting by the front detection sensor (not shown) allows the OHT system of the semiconductor manufacturing apparatus to perform efficient processing of the semiconductor wafer. This makes it possible to further improve the production efficiency of semiconductor devices or the like.

The aforementioned embodiment is one example to describe the present invention. However, the present invention is not limited to the above embodiment, and various modifications may be possible within the gist of the invention. Namely, the aforementioned embodiment described the case in which the front detection sensor is provided on an OHT vehicle that runs along a ceiling rail. However, the present invention is not limited to this. For example, it is possible to provide the front detection sensor on an AGV that runs on the floor or an RGV that runs on a rail. The AGV and the RGV are used in process lines in which materials are transported and finished products are moved without human intervention in an automated factory. The provision of the front detection sensor of the present invention prevents the AGV and the RGV from being stopped unnecessarily and from colliding with the other parts and breaking them.

Figure 4:
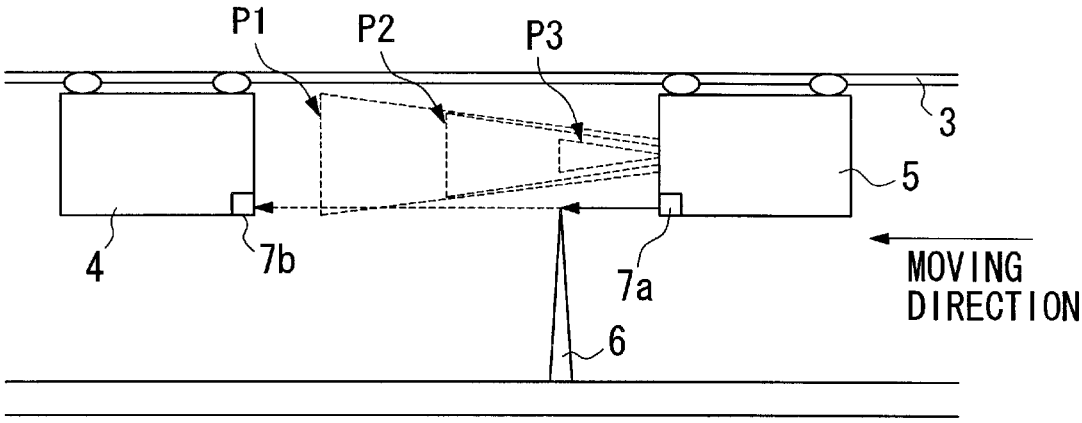
FIG. 4 is a conceptual view showing a state in which a long range detection sensor and a short range detection sensor detect an implement in an OHT system of the present invention.

Next, an explanation is given of the operation system of the present invention in the case that a plurality of vehicles, each having the aforementioned optical sensors, run on the rail. FIG. 4 is a conceptual view showing a state in which a long range detection sensor and a short range detection sensor detect an obstruction in the OHT system of the present invention. In addition, the long range detection sensor device a sensor which has the longer detection range than that of the short range detection sensor.

In FIG. 4, in the OHT system of the present invention, a front vehicle 4 and a trailing vehicle 5 hang on a rail 3 and run in the advancing direction indicated by the arrow in the figure. Moreover, a stepladder 6 with a height which does not obstruct the movement of vehicles 4 and 5, is placed in pass of the respective vehicles 4 and 5. Moreover, each of the vehicles 4 and 5 has the optical sensors at its front surface as shown in FIGS. 1 and 2, although these sensors are not illustrated in FIG. 4. Further, the trailing vehicle 5 has a vehicle determination sensor (light receiving device) 7*a* as an obstruction determining device, which determines whether the obstruction ahead is a vehicle or not, on its front surface. The front vehicle 4 has a vehicle determination sensor (light emitting device) 7*b* on its rear surface.

Now, a description is given of a case in which the trailing vehicle 5 is running while detecting ahead using the optical sensor (not shown). The optical sensor of the vehicle 5 has a long range detection sensor and a short range detection sensor. The long range detection sensor switches among two range, i.e., of the long range P1 and the medium range P2, making it possible to detect an obstruction. For example, the long range P1 can be used to detect obstructions at a distance of 2 to 3 m, and the medium range P2 can be used to detect obstructions at a distance of 0.5 to 1.5 m. Moreover, a short range detection sensor can detect obstructions in a short range P3, which is shorter than the middle range P2 (that is, 0.5 to 1.5 m).

Firstly, when the trailing vehicle 5 advances, the long range detection sensor, which is provided on the vehicle 5, detects the obstruction (that is, front vehicle 4) with in the long range P1. As a result, if the vehicle 5 continues to advance while reducing its speed, the long range detection sensor detects the obstruction (that is, vehicle 4) within the middle range P2. Thereafter, when the vehicle determination sensor (light receiving device) 7*a*, which the vehicle 5 has, receives an optical signal from the vehicle determination sensor (light emitter) 7*b* of the vehicle 4, which is the obstruction ahead, and thereby confirms that the obstruction ahead is the vehicle 4, and the rear vehicle 5 further reduces its speed. Then, the vehicle 5 advances until the short range detection sensor of the vehicle 5 detects the vehicle 4 within the short range P3. Thereafter, at the point when the short range detection sensor of the vehicle 5 detects the vehicle 4 at the short range P3, the vehicle 5 stops. For example, the short range P3 is set to about 0.2 to 0.1 m such that the back vehicle 5 is stopped at the shortest range at which the vehicle 5 does not collide with the front vehicle 4.

If there is a station (transfer port of assembly apparatus) which has made a transfer request to the vehicle 5 which is located at a position which is before the vehicle reaches within the short range P3, the vehicle 5 can be stopped at the position of the station. When the vehicle 5 reaches the station which has made the transfer request to the vehicle 5 while the long range detection sensor is detecting in long range P1 or the medium range P2 and braking is performed, it is possible to stop the vehicle 5 at the corresponding station before the short range detection sensor detects in the short range P3.

Moreover, if the vehicle determination sensor (light receiving device) 7*a* provided on vehicle 5, cannot confirm that an obstruction ahead is a vehicle 4 when the long range detection sensor provided on the vehicle 5 detects the obstruction within the long range P1 or the middle distance P2 while the trailing vehicle 5 is advancing. When no optical signal is received from the vehicle determination sensor (light emitting device) 7*b* of the front vehicle 4, it is determined that the obstruction ahead is not a vehicle.

In this case, since the detected obstruction is, for example, the stepladder 6, the vehicle 5 can be immediately stopped or the vehicle 5 can be stopped after advancing the vehicle 5 close to the stepladder 6 according to the pre-setting of the OHT system. The above embodiment describes the case in which the long range detection sensor is operated in the two steps of the long distance P1 and middle distance P2. However, the long range detection sensor may be operated to detect a predetermined distance in only one step. Moreover, the number of long range detection sensors provided at the front surface of the vehicle is not limited to one. Namely, a plurality of sensors may be provided as the optical sensors shown in the aforementioned FIG. 1.

Herein, specific embodiments of the vehicle determination sensor, which is an obstruction determining device, will be described in more detail. Regarding the first embodiment, as illustrated in FIG. 4, a vehicle determination sensor (light receiving device) 7*a* is provided at the front portion of each vehicle and a vehicle determination sensor (light emitting device) 7*b* is provided at the rear portion. When the vehicle determination sensor (light receiving device) 7*a* of the front portion of the trailing vehicle 5 receives an optical signal from the vehicle determination sensor (light emitting device) 7*b* of the rear portion of the front vehicle 4, it is determined that the obstruction ahead is a vehicle.

Moreover, in the second embodiment of the vehicle determination sensor, a reflector is provided at the rear portion of the front vehicle 4, and a reflection sensor, which receives an optical signal from the reflector, is provided at the front portion of the trailing vehicle 5. When the reflection sensor of the trailing vehicle 5 receives the optical signal, it is determined that the obstruction ahead is a vehicle. When the reflecting sensor of the trailing vehicle 5 receives no optical signal, it is determined that the obstruction ahead is not a vehicle.

Furthermore, regarding the third embodiment of the vehicle determination sensor, as described in the aforementioned FIG. 1, the plurality of sensors are arranged along the outer periphery of the vehicle and the plurality of sensors operate on the principle of an AND operation making it possible to more reliably recognize that the obstruction ahead is the vehicle. In other words, as mentioned in FIG. 1 and FIG. 2, concerning the optical sensors, that is, obstruction detection sensors, four optical sensors S1, S2, S3, and S4 are provided along the respective sides of the front surface portions in the moving direction of each vehicle. Then, the sensors are designed to detect the outer peripheral area of a vehicle running ahead. Therefore, when an area different from this area is detected, it is determined that the obstruction ahead is not the vehicle.

In other words, based on the AND condition applied to the four optical sensors S1, S2, S3, and S4, only when the signals are sent by all optical sensors S1, S2, S3, and S4, it is determined that the obstruction ahead is a vehicle. Then, when no signal is sent by any one of the optical sensors, it is determined that the obstruction ahead is not the vehicle. Furthermore, the detection of a logical sum using a plurality of sensors in this way leads to the effect that the trailing vehicle is effectively moved forward. In addition, even if the plurality of vehicle determination sensors 7*a* and 7*b* of FIG. 4 and logic such as an OR condition are used, there is the effect that the trailing vehicle is effectively moved forward.

Note that, as specific embodiments of the above-described long range detection sensor and the short range detection sensor, there are conical beam sensors, which output long conical beams, beam scanning sensors, which scans beams, and the like.

Figure 5A:
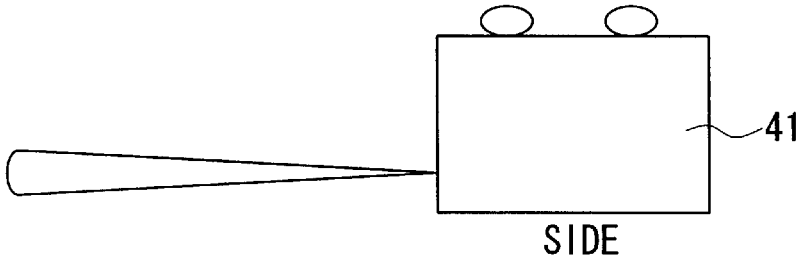
FIG. 5A is a view showing one example of a detection range when conical beam sensors as sensor S1 and S2 of FIG. 1 are used, and a view showing the detection range when the vehicle is seen from the side.
Figure 5B:
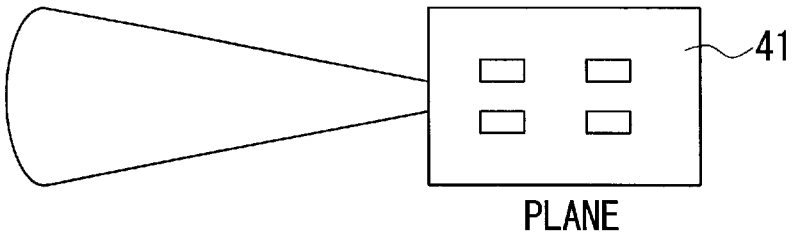
FIG. 5B is a view showing one example of a detection range when conical beam sensors as sensor S1 and S2 of FIG. 1 are used, and a view showing the detection range when the vehicle is seen from the plane.

FIG. 5 is a view showing one example of using conical beam sensors as sensors S1 and S2 of FIG. 1 to detect the upper end and lower end. FIG. 5A is a view showing the detection range when the vehicle is seen from the side surface, and FIG. 5B is a view showing the detection range when the vehicle is shown upper side.

Thus, when the conical beam sensors are used as sensors S1 and S2, the detecting range has a conical shape expanding widely in a width direction and thinly in a height direction.

Figure 7:
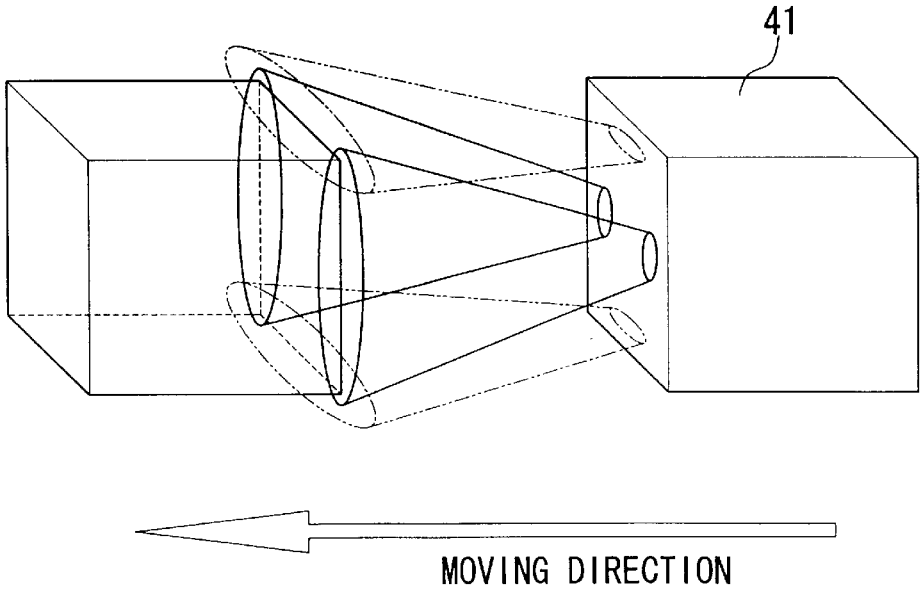
FIG. 7 is a view showing one example of a detection range when the conical beam sensors are provided around the vehicle.

Moreover, FIG. 7 shows one example of a detection range. In this figure, the conical beam sensors shown in FIG. 5 are arranged near the outer periphery of the vehicle 41.

Figure 6A:
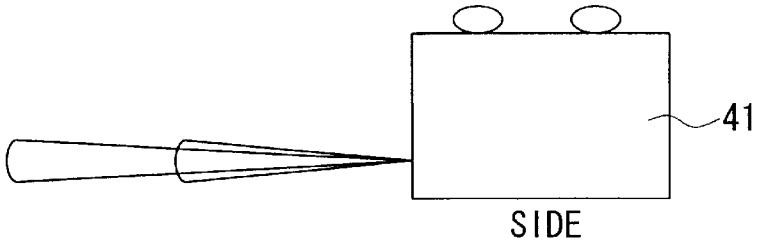
FIG. 6A is a view showing one example of a preferable detection range of a sensor provided to correspond to the sensor shown in FIG. 5, and a view showing the detection range when the vehicle is seen from the side surface.
Figure 6B:
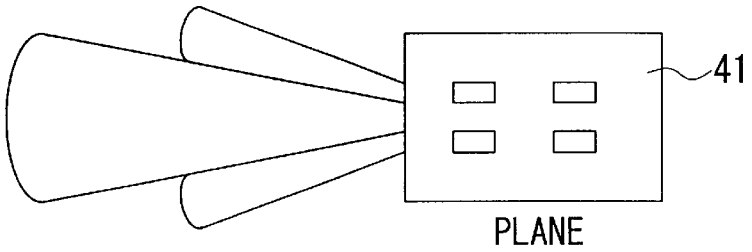
FIG. 6B is a view showing on example of a preferable detection range of a sensor provided to correspond to the sensor shown in FIG. 5, and a view showing the detection range when the vehicle is seen from the plane.

Also, FIG. 6A and FIG. 6B are views, each showing examples of the detection range of the conical beam sensor. As illustrated in these figures, it is preferably that the sensor has a wide detection range in which obstructions near the vehicle are detected.

Figure 8:
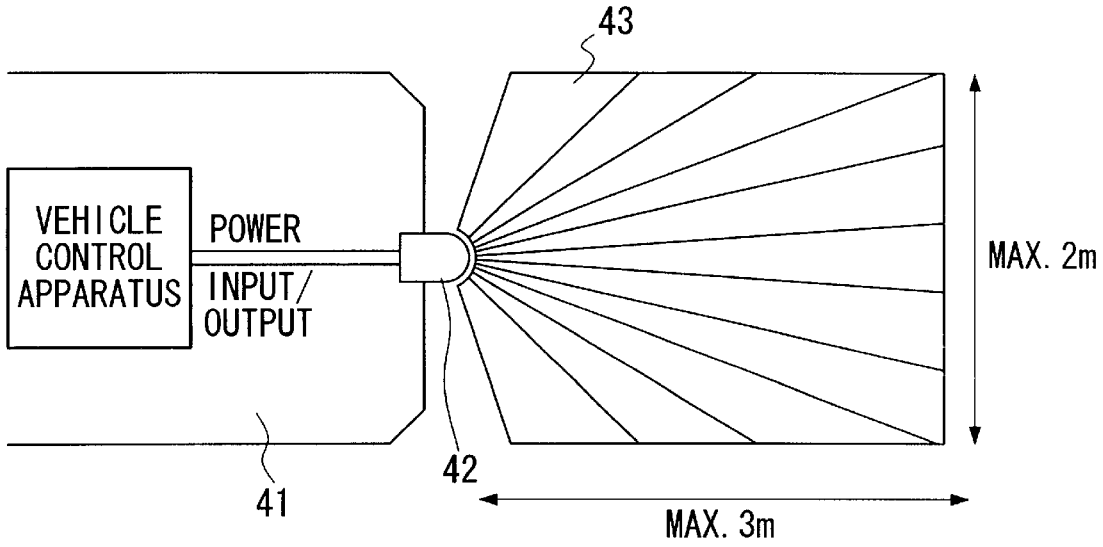
FIG. 8 is a schematic view showing one example of a beam scan sensor.
Figure 9:
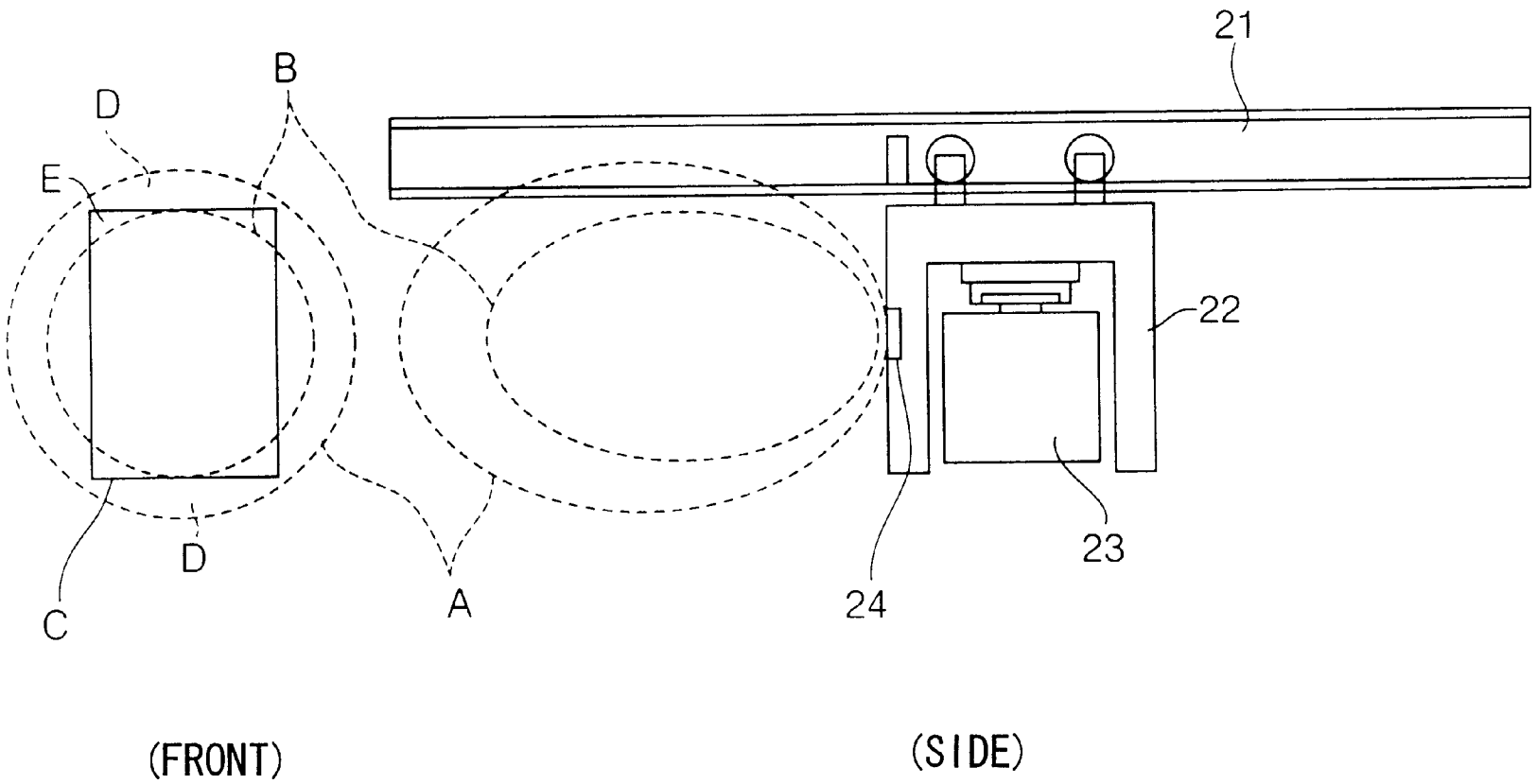
Figure 10:
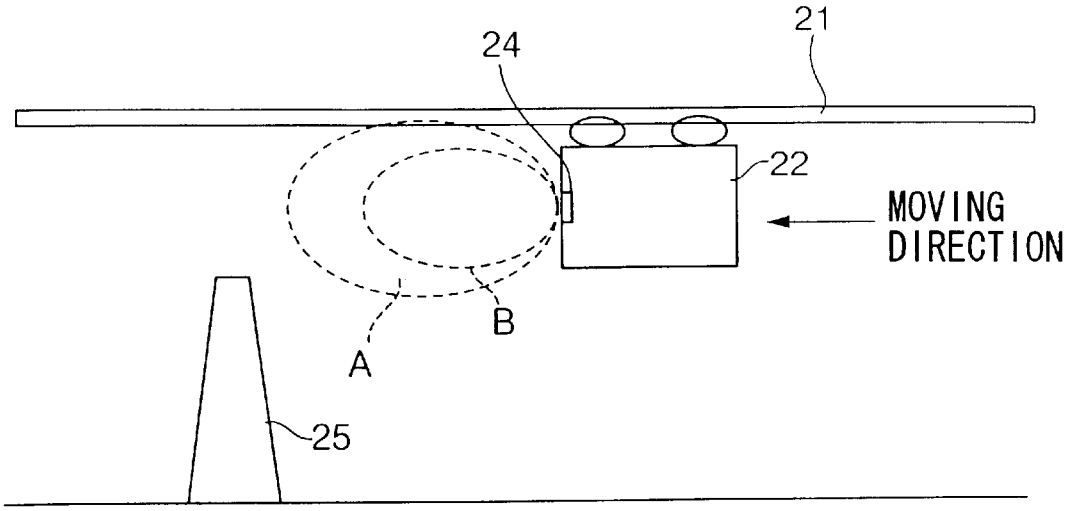
FIG. 10 is an explanatory view showing a front detection sensor of the OHT vehicle and one example of an obstruction.
Figure 11:
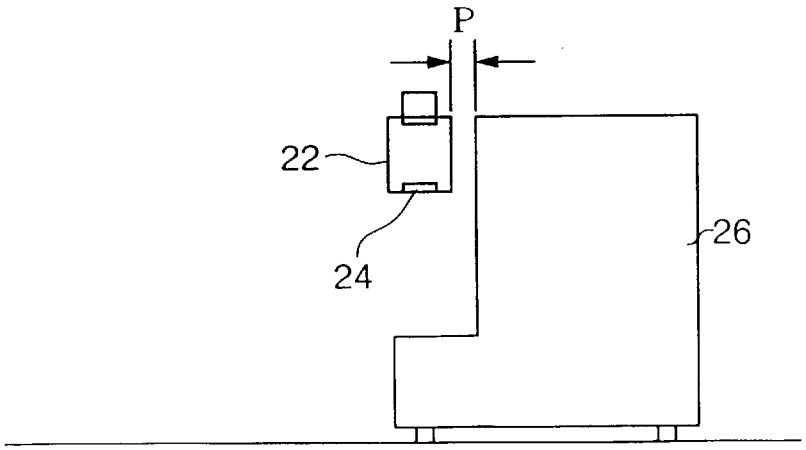
FIG. 11 is a conceptual view showing an OHT vehicle used in a semiconductor manufacturing apparatus.
Figure 12:
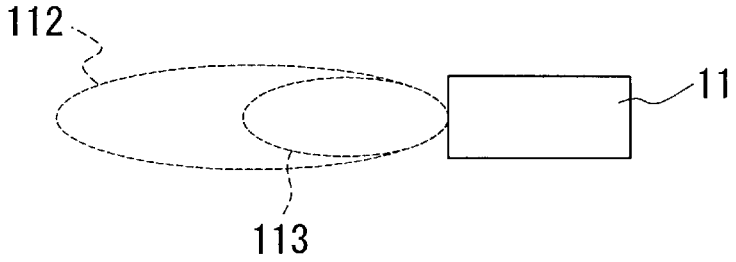
FIG. 12 is a conceptual view showing a state in which the vehicle uses two front detection sensors to detect a long distance range and a middle distance range.
Figure 13:
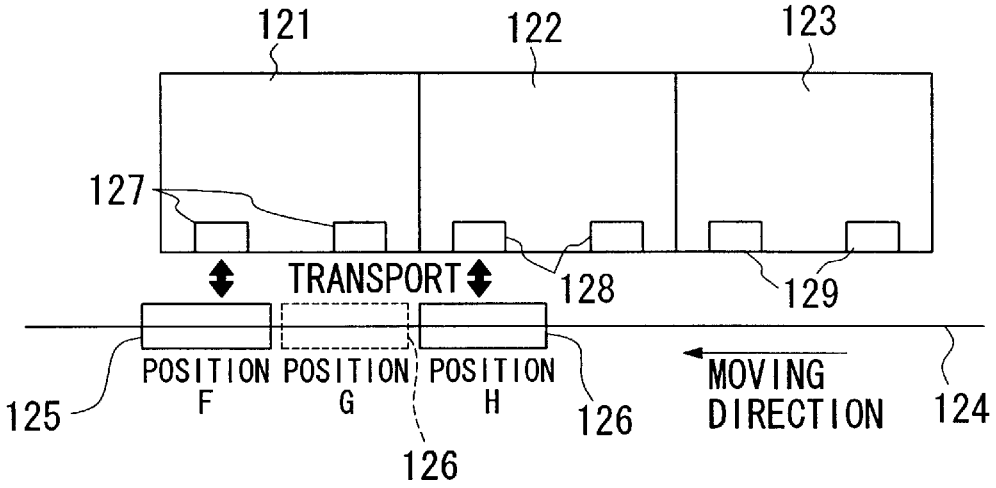
FIG. 13 is a conceptual view showing one example of an operation state of a plurality of vehicles in the general OHT system.

FIG. 8 is a schematic view showing one example of the beam scan sensor. This figure shows a state in which scanning with rays of light emitted from an LED 42, which is provided at the front surface of an AGV 41 that runs on the floor surface, is performed for long range and short range detection. For example, a semi-circular field 43 is scanned with rays of light with a wavelength of $\lambda$=870 nm emitted from the LED 42 at a step 9 (angle (162°). Then, coordinates are calculated based on a distance measurement and the step angle so as to detect an obstruction. Also, the detection area can be optionally selected, and the setting of the detection area can be carried out by any method such as a volume operation or an operation of a personal computer. For example, the detection area is set by the operation of a personal computer, making it possible to optionally switch the areas from among seven patterns.

The aforementioned embodiment is one example to describe the present invention. However, the present invention is not limited to the above embodiment, and various modifications may be possible within the gist of the invention. Namely, the aforementioned embodiment describes the case in which the front detection sensor is provided on an OHT vehicle that runs along a ceiling rail. However, the present invention is not limited to this. For example, it is possible to provide the front detection sensor on an AGV that runs on the floor or on an RGV that runs on a rail. AGV and RGV's are used in process lines in which materials are transported and finished products are moved without human intervention in an automated factory. The provision of the front detection sensor of the present invention prevents AGV's and RGV's from being stopped unnecessarily and from colliding with the other parts and breaking them.

Although the preferred embodiments of the present invention have been described in detail, it should be understood that various changes, substitutions and alternations can be made thereto without departing from spirit and scope of the inventions as defined by the appended claims.

What is claimed is:

1. An automatic transport system for transporting articles, comprising a front detecting device which detects an obstruction in a non-contact state in an area through which an automatic transport vehicle passes, said front detecting device emitting a plurality of beams such that the respective sides of said beams are connected to one another, and a projection surface of said automatic transport vehicle, and when said front detecting device detects an obstruction in said area, the running speed of said automatic transport vehicle is reduced or said automatic transport vehicle is stopped.

2. The automatic transport system according to claim 1, wherein said front detecting device is an optical sensor, which emits an optical beam so as to irradiate an entire outer periphery of a projection surface of said automatic transport vehicle, and said optical sensor detects an obstruction in said area.

3. The automatic transport system according to claim 2, wherein a plurality of said optical sensors are provided near the outer periphery of a front surface of said automatic transport vehicle, said optical sensors respectively emit the optical beams that irradiate an area covering of an entire outer periphery of the projection surface of said automatic transport vehicle, and said optical beams are fan-shaped.

4. The automatic transport system according to claim 3, wherein the area irradiated by said optical beams lies partially outside of the outer periphery of said projection surface.

5. The automatic transport system according to claim 4, wherein said automatic transport vehicle is any one of an Overhead Hoist Transport vehicle that runs on a ceiling rail, an Automatic Guided Vehicle that runs on a floor, or a Rail Guided Vehicle that runs on a rail on a floor.

* * * * *